US010012455B2

(12) United States Patent
Franzino et al.

(10) Patent No.: US 10,012,455 B2
(45) Date of Patent: Jul. 3, 2018

(54) DESCALING SYSTEM FOR HEAT EXCHANGE EQUIPMENT

(71) Applicants: Joseph J. Franzino, Redding, CT (US); George M Cruz, Norwalk, CT (US)

(72) Inventors: Joseph J. Franzino, Redding, CT (US); George M Cruz, Norwalk, CT (US)

( * ) Notice: Subject to any disclaimer, the term of this patent is extended or adjusted under 35 U.S.C. 154(b) by 322 days.

(21) Appl. No.: 14/544,409

(22) Filed: Jan. 2, 2015

(65) Prior Publication Data

US 2015/0107626 A1 Apr. 23, 2015

Related U.S. Application Data

(62) Division of application No. 12/657,683, filed on Jan. 25, 2010, now Pat. No. 8,926,765.

(51) Int. Cl.

| | |
|---|---|
| ***B08B 9/032*** | (2006.01) |
| ***F28G 9/00*** | (2006.01) |
| ***B08B 9/027*** | (2006.01) |
| ***C23G 1/02*** | (2006.01) |
| ***C23G 1/14*** | (2006.01) |
| ***C23G 3/04*** | (2006.01) |
| ***F28G 15/00*** | (2006.01) |
| *C11D 11/00* | (2006.01) |

(52) U.S. Cl.

CPC ..... *F28G 9/00* (2013.01); *B08B 9/027* (2013.01); *B08B 9/032* (2013.01); *C23G 1/02* (2013.01); *C23G 1/14* (2013.01); *C23G 3/04* (2013.01); *F28G 15/003* (2013.01); *C11D 11/0041* (2013.01)

(58) Field of Classification Search

CPC ..... C23G 1/14

See application file for complete search history.

(56) References Cited

U.S. PATENT DOCUMENTS 4,675,120 A * 6/1987 Martucci ..... C03C 23/0075 134/3

4,899,798 A * 2/1990 Martin ..... C23G 1/36 134/12

* cited by examiner

*Primary Examiner* — Jason Ko

(74) *Attorney, Agent, or Firm* — Patrick J. Walsh

(57) ABSTRACT

A system for descaling heat exchanger surfaces using a varying concentration of either an acidic or alkaline solution, selecting an optimum pH value for descaling a heat exchanger according to the level of cleaning the heat exchanger requires, monitoring pH value of descaling solution during circulation through a heat exchanger, and adding chemical solution to achieve coincidence of optimum and monitored pH values during descaling operation.

4 Claims, 4 Drawing Sheets

DESCALING SYSTEM FOR HEAT EXCHANGE EQUIPMENT

This application is a division of U.S. application Ser. No. 12/657,683 filed Jan. 25, 2010, now U.S. Pat. No. 8,926,765.

BACKGROUND OF THE INVENTION

This invention relates to and solves the problem of buildup of scale and hard water deposits on heat transfer surfaces of heat exchange equipment.

In shell and tube heat exchangers in which water is used as a heat transfer medium, materials dissolved in the water including metal oxides, inorganic salts, calcium and mineral deposits form scale deposits on the inside surfaces of the tubes. These scale deposits can seriously reduce the efficiency of heat exchange equipment, can lead to higher operating costs and expensive repairs or even replacement of entire units and must be removed from heat exchange surfaces so that the heat exchanger can operate at design efficiency.

There is advantage in a system for removing scale and mineral deposits from heat exchangers using a descaling solution of particular strength and maintaining selected strength for duration of descaling operation. Such a system provides efficient descaling with minimum downtime while restoring a heat exchanger to design thermodynamic efficiency.

The present invention has for its chief objective a system for descaling heat exchanger using a chemical solution for improved economic and thermodynamic operating efficiency of a power plant.

SUMMARY OF THE INVENTION

The present invention provides a system for descaling heat exchanger surfaces by circulating a dilute solution of either an acidic or alkaline chemical in water to remove scale and mineral deposits. The system enables maintenance personnel in judging level of descaling needed for a given heat exchanger and selecting chemical to water dilution ratio of solution required for such descaling level. The system circulates selected solution for descaling and maintains strength of solution by adding chemical while solution tends to lose descaling potency as it dissolves scale and mineral deposits. The system employs a preset optimum pH value for descaling solution required for a level of cleaning or descaling for a given heat exchanger. The system stores such optimum value in a pH controller unit. At the same time the system monitors pH value of circulating solution, and when monitored value rises with respect to optimum pH value, the pH controller directs an addition of chemical to the circulating chemical to lower its pH value toward optimum. When optimum and monitored value coincide and remain coincident for a fixed period, the system regards the heat exchange surfaces to be descaled and provides the operator with an indication that cleaning is completed and the system may be secured.

Specific examples are included in the following description for purposes of clarity, but various details can be changed within the scope of the present invention.

OBJECTS OF THE INVENTION

An object of the invention is to provide a descaling system for open bath vessel and for closed heat exchangers.

Another object of the invention is to provide a self-contained portable machine for removing scale and mineral deposits from heat exchange surfaces of open and closed vessels.

Another object of the invention is to provide a system for circulating a descaling solution of selected strength for cleaning heat exchanger surfaces, and for monitoring and maintaining selected strength of solution until descaling is complete.

Another object of the invention is to provide a descaling machine using a descaling solution and utilizing pH value of circulating solution in comparison to a pre-selected optimum pH value stored in a controller for monitoring progress of descaling operation.

Another object of the invention is to provide for cleaning heat exchange surfaces of scale and mineral deposits with a solution of either an acidic or alkaline chemical under safe and efficient conditions.

Other and further objects of the invention will become apparent with an understanding of the following detailed description of the invention or upon employment of the invention.

BRIEF DESCRIPTION OF THE DRAWING

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE PREFERRED EMBODIMENT

Figure 1:
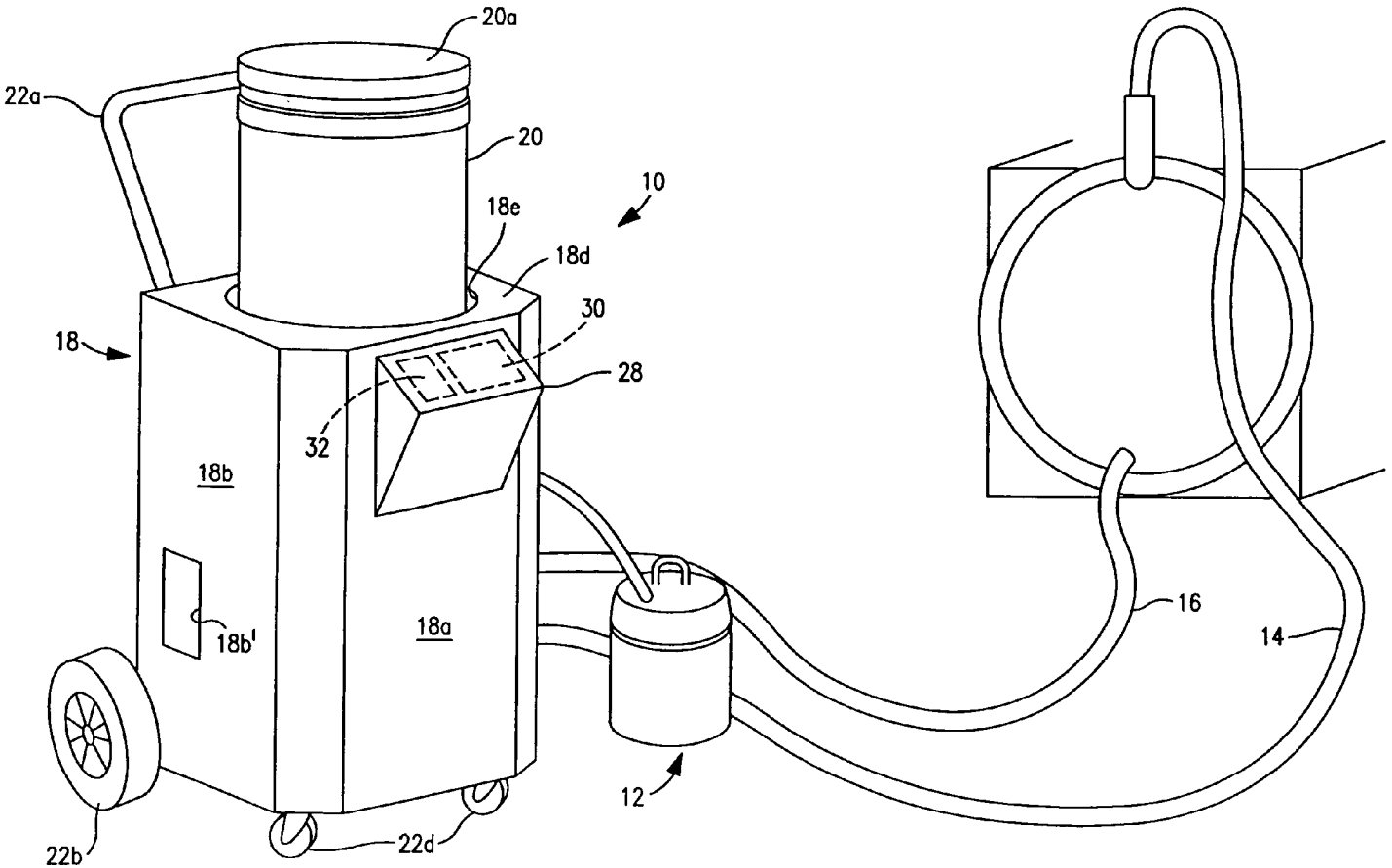
FIG. 1 is a perspective view of descaling machine in position for descaling a heat exchanger according to the invention.

Referring to the drawing, the present invention is directed to a descaling system for heat exchange equipment including descaling machine 10 for mounting solution circulating and monitoring components of the system, portable container 12 for adding descaling chemical to descaling solution, inlet 14 and return 16 lines for flow of solution to heat exchanger.

Machine housing 18 is a shell defined by upright front 18*a*, side 18*b* and rear 18*c* walls with closed bottom wall, and top wall 18*d* having a recess or well 18*e* to receive a venting drum 20 with cover 20*a*. The machine is moved about by means of a hand truck 22 including handle 22*a*, truck wheels 22*b*, wheel skids 22*c*, and front casters 22*d*.

The housing interior positions a main pump 24 (FIG. 5) for circulating a descaling solution through the system, and a chemical pump 26 for adding descaling chemical to the descaling solution. Electrical components for pump operation and control and monitoring of descaling progress are also located within the housing.

Housing front wall has a built-in control panel 28 defined by supporting walls and a control dashboard panel 30 inclined from front wall for convenient positioning of machine control switches and indicators for operator use. The control panel also mounts a pH controller 32 for embodiments of the invention described in detail below.

A side wall 18*b* of the housing has opening 18*b*' for access to a system circulating line for positioning a pH sensor 34 to monitor progress of a descaling operation applied to a given heat exchanger.

The rear wall of the housing is open for convenient location of a set of valves for directing descaling solution flow through system lines including main pump inlet valve 36, main pump outlet valve 38, and venting drum valve 40.

Figure 3:
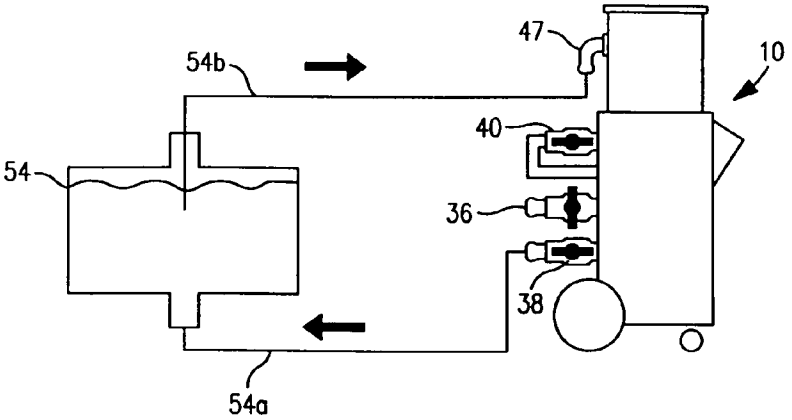
FIG. 3 is a schematic view of descaling machine for descaling a closed vessel heat exchanger according to the invention.
Figure 4:
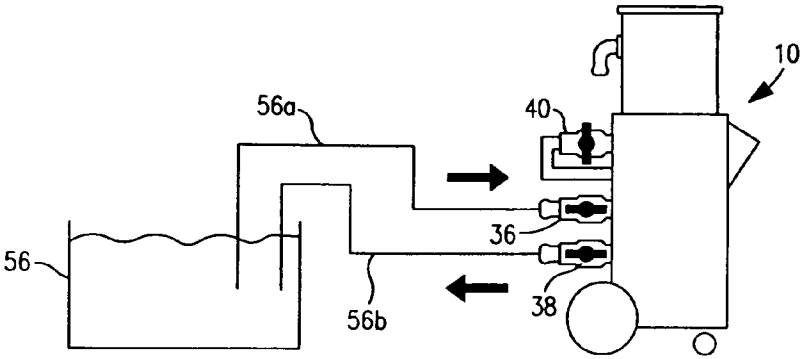
FIG. 4 is a schematic view of descaling machine for descaling an open bath vessel according to the invention.
Figure 2:
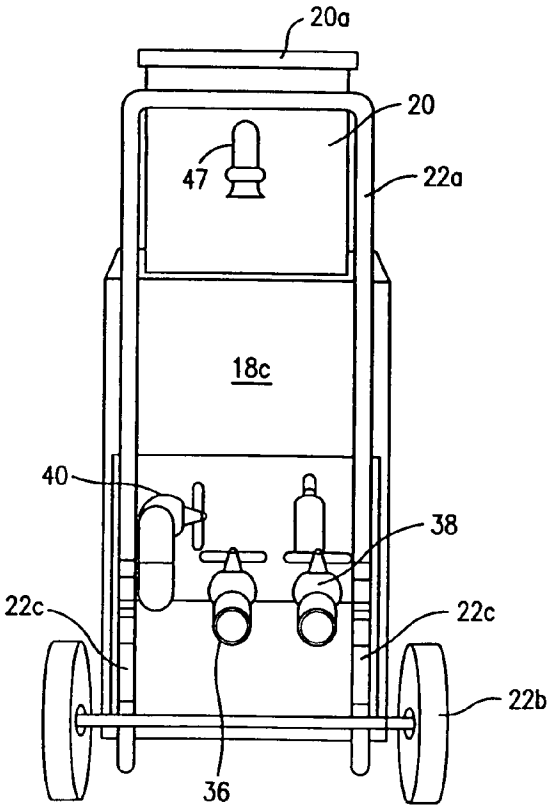
FIG. 2 is a rear elevation of the machine of FIG. 1.
Figure 5:
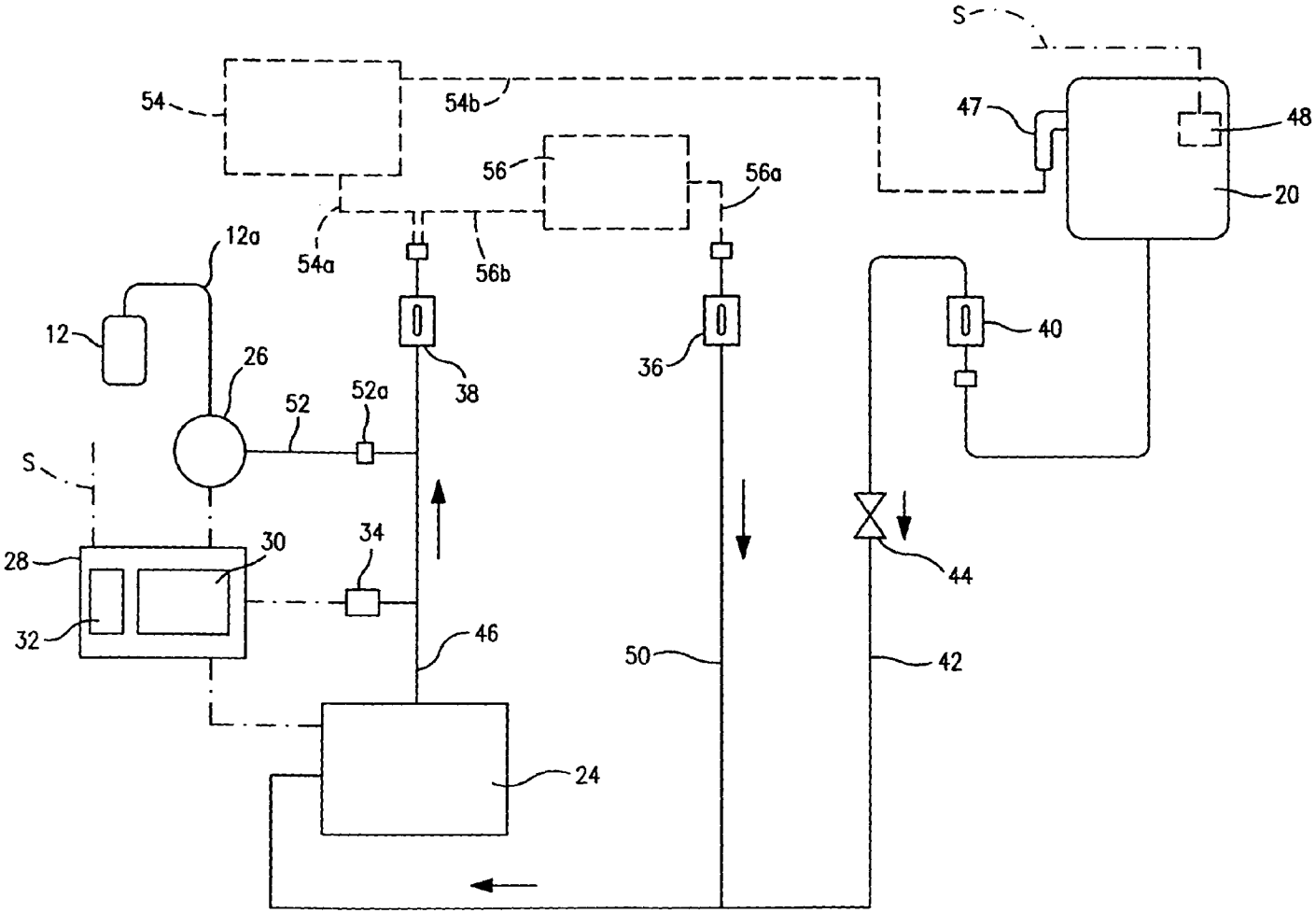
FIG. 5 is a schematic view of machine components for selective use in closed and open vessel descaling operation.

FIGS. 3-5 are schematic views of descaling solution flow circuits for a closed heat exchange vessel (FIG. 3) and for an open bath vessel (FIG. 4). An open bath vessel is used for immersing metal plates, coils from hot pressure washers, and other articles in need of descaling.

As shown in FIGS. 3 and 5, main electric motor driven circulating pump 24 receives return flow of descaling solution from closed vessel vent drum 20, through vent drum valve 40 and inlet line 42 and one-way check valve 44. The circulating pump discharges solution through line 46 and outlet valve 38 to the closed vessel.

Venting drum 20 mounted in top wall well functions as a point of entry of chemical into the system and as a reservoir or surge tank providing adequate volumetric capacity in the descaling system for handling variations or surge of descaling solution during a descaling operation for a closed vessel heat exchanger.

Drum is fitted with an overfill vent 47 and level sensor 48 to ensure that the drum does not overflow when the main circulating pump is in operation. Should the sensor fail, overflow can be directed to a drain via a garden hose. In the event solution level in the drum rises to overfill level, the overfill sensor sends a signal to the control panel indicator lamp 30*a* (FIG. 6) telling the machine operator to shut down the main circulating pump and to drain solution from the drum to a level where the bottom of the overfill sensor is visible.

As shown in FIGS. 4 and 5, main electric motor driven circulating pump 24 receives return flow of descaling solution from open vessel 56 through line 56*a*, inlet valve 36, and line 50, and discharges solution through line 46, outlet valve 38, and line 56*b* to the open vessel.

Chemical pump 26 transfers descaling chemical from source container 12 and feed line 12*a* directly into outlet line 46 by means of hose 52 and male connection 52*a* as needed to maintain desired pH level for descaling heat exchanger surfaces.

pH 34 sensor is fitted to the outlet line 46 for sensing pH value of descaling solution flowing to a heat exchanger. The sensor provides a reading and corresponding signal to the pH controller 32. The pH controller operates the chemical pump for adding descaling chemical to the solution as necessary to ensure that descaling continues until all scale is removed from heat transfer surfaces of the open vessel.

The descaling system according to the invention uses a chemical consisting of varying concentration of either an acidic or alkaline chemical in water. In operation, the chemical is diluted with water and circulates through a heat exchanger for removing scale and mineral deposits. A water to chemical dilution ratio in a range of 0 to 5:1 is selected according to level of cleaning from heavy to light required to descale a given heat exchanger.

In accordance with the invention, progress of a descaling operation is determined by monitoring pH value of circulating solution and comparing monitored value with a normal or optimum pH value selected and set in a pH controller. Solution pH value is monitored by a pH sensor installed in the solution circulating line, preferably in the main circulating pump outlet line. As monitored pH rises above normal pH value while descaling solution is circulating through a heat exchanger, scale and mineral deposits are being removed from heat exchanger surfaces. The pH controller compares monitored and normal pH values and uses the difference between values for operating the chemical pump to add chemical solution to circulating descaling solution. As descaling occurs, scale and mineral deposits dissolve in acidic or alkaline solution, solution loses descaling potency, monitored pH value rises with respect to normal value, and descaler chemical is added to circulating solution restore potency and to lower monitored pH to normal level. When monitored and normal pH values coincide, surface descaling is being completed. At this point, the descaling system continues to circulate solution through a heat exchanger for a fixed time period, say one hour, during which monitored pH value is compared to normal. If during this time period, monitored value does not exceed normal value, an indicator light at the end of the time period signals that the descaling operation has been completed and that the heat exchanger surfaces are clean.

In practicing the invention, the acidic solution is a mixture of water and any one of the following acids: hydrochloric, sulfuric, phosphoric, nitric acid in a water-to-acid ratio in a range of 0:1 to 5:1. The alkaline solution is a mixture of water and any one of the following alkalines: caustic, calcium hydroxide, sodium carbonate, potassium hydroxide, calcium carbonate, and ammonium hydroxide in a water-to-alkaline ratio of 0:1 to 5:1.

Referring again to the drawing, a descaling operation commences by rolling the descaling machine into position at a heat exchanger connecting circulating line hoses as shown in FIG. 1. For a closed vessel 54, circulating line hoses 54*a,b* are connected as in FIGS. 3 and 5. Descaling chemical is added to the system through the venting drum or injected from an external container and pumped into the closed vessel. After all required chemical is added to the system, diluting water is added through the venting drum to achieve desired dilution ratio for given heat exchanger. A container 12 of descaling chemical is connected by its feed line to the outlet side of the chemical pump for lowering monitored pH value to optimum pH value when descaling a surface. The pH sensor is installed through side opening 18*b*' to main circulating outlet line.

If the closed vessel has a relatively low volume, say 15 gallons, the vessel is filled directly with water and chemical is fed into the system by chemical pump from container and its feed line.

The system is connected to an electric power source and main power lamp 30*b* (FIG. 6) illuminates at the control panel. The main pump switch 30*c* is placed in "on" position for normal circulation of solution through the heat exchanger. The control panel further includes a chemical pump lamp 30*d* that lights when the chemical pump is operating, overfill alarm lamp 30*a* that lights when the venting drum is overfilled and the chemical pump is disengaged, and a cleaning-in-progress lamp 30*e*. The panel also has a reset switch for main circuit breaker 30*f*.

The cleaning-in-progress lamp is lit whenever the chemical pump is injecting or has injected chemical into the system. If the pH controller does not inject any chemical concentrate for a period of one hour, the lamp goes out signaling that pH has not risen in one hour and cleaning is completed. At this point, the descaling solution is neutralized and discarded according to applicable environmental regulations.

Figure 6:
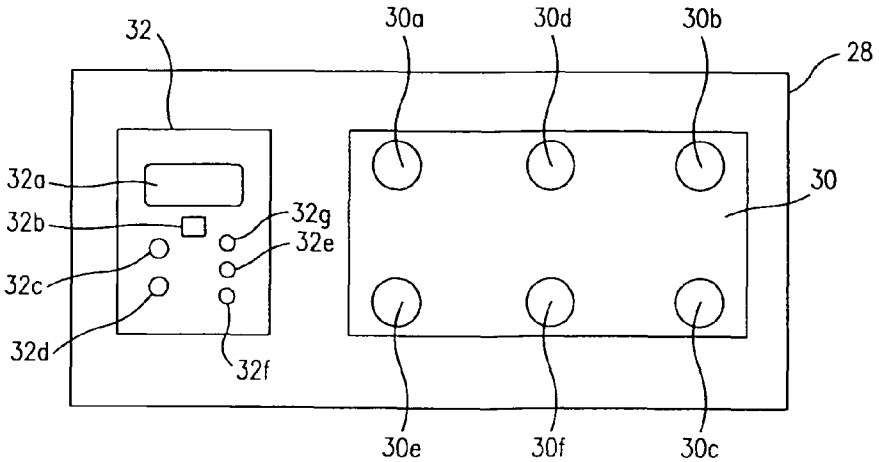
FIG. 6 is a schematic view of control panel with pH controller and machine controls for the machine of FIG. 1.

The pH controller 32 shown in FIG. 6, comprises a display panel 32*a*, a three-way operating switch 32*b*, a switch for displaying current pH level of circulating chemical solution 32*c*, an display/adjust switch 32*d* for selecting a set point, i.e., a normal pH level for comparison to monitored pH level of circulation solution, adjustment ports for calibration adjustment 32*e* of instrument and for set point 32*f* (normal pH level) selection. An indicator lamp 32*g* lights when monitored pH is above normal pH level showing also that the chemical pump is operating.

A suitable pH controller has three operating modes of switch 32*b*: "off" to display current pH value of solution, "auto" to display current pH level of solution and to turn on chemical pump for adding chemical to circulating solution when monitored pH value is above optimum or set point pH stored in controller, and "on" to display current pH value of solution and to operate the chemical pump continuously to inject chemical into the circulating solution.

Figure 7:
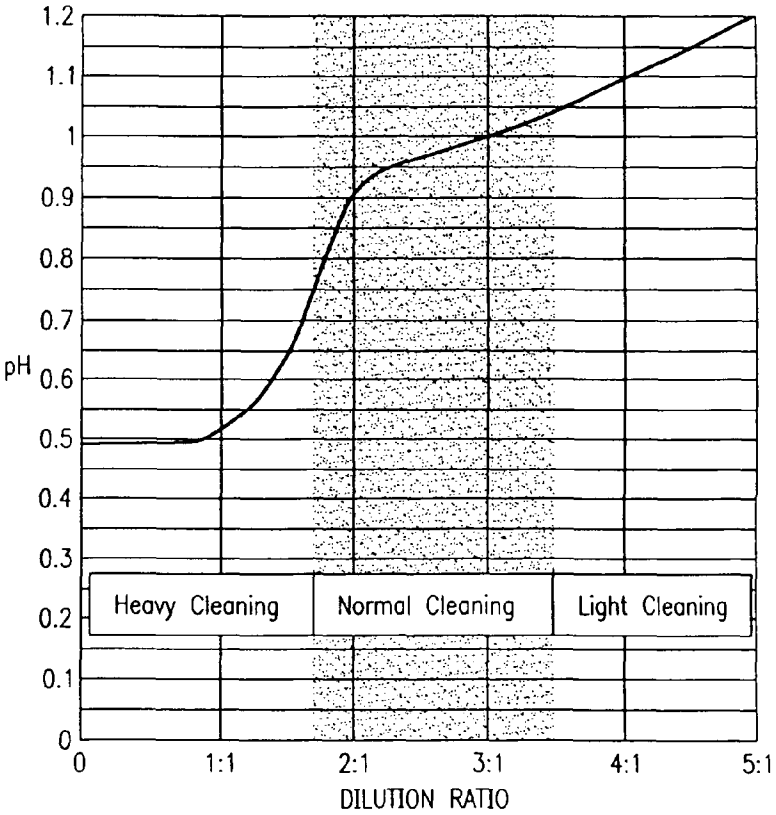
FIG. 7 is a chart depicting dilution ratio of descaling solution according to level of cleaning need for heat exchange surfaces.

The descaling system according to the invention uses a chemical available under the trademark SCALEBREAK® available from Goodway Technologies Corporation of Stamford Conn. and consisting of approximately a 10% concentration of buffered hydrochloric acid in water. The chemical is mixed with water to form a descaling solution. The ratio of water to chemical in descaling solution is selected according to the degree or level of cleaning required for a given heat exchanger. As shown in FIG. 7, heavily scaled heat exchanger surfaces require more chemical while lightly scaled surfaces require less chemical.

The curve traced in the chart correlates normal or optimum pH value of solution with its dilution ratio. Undiluted chemical, i.e., a 10% concentration of hydrochloric acid in water has a 0.5 pH. As the chemical is further diluted, pH rises according to the curve reaching a value of 1.2 pH at 5:1 water-to-chemical dilution. The chart is divided vertically into cleaning zones for heavy, normal and light level of cleaning over a dilution range of 0 to 5:1. In using the descaling system, maintenance personnel begin by inspecting heat exchange surface and noting level of cleaning required. Referring then to the chart, appropriate dilution ratio and its optimum pH value are selected.

For heavily befouled surfaces, FIG. 7 shows that a dilution ratio in a range of 0 to approximately 1.7:1 is required to clean surfaces. Using the graph, the operator selects a pH value of 0.5 to 0.75 as set point selected for the pH controller. In like manner, chemical will be added to circulating water by pH controller actuation of chemical pump in required dilution ratio.

For a closed system of FIGS. 3 and 5, venting drum is filled above bottom of overfill level sensor with chemical and water in selected dilution ratio. As descaling progresses and scale and deposits are dissolved, the pH of the cleaning solution will tend to rise. The pH sensor monitors pH level of circulating solution and when pH so rises, the pH controller injects concentrated chemical into the circulating solution lowering the pH to the optimal level, the predetermined set point for the cleaning operation. When monitored pH level reaches set point or normal in range of 0.5 to 0.75 pH, and remains at normal level for an hour, cleaning in progress lamp on the control panel goes "off" as an indicator that cleaning is complete.

For heat exchangers requiring normal cleaning, a dilution ratio in a range of 1.7:1 to 3.4:1 water to chemical, and a set point in a range of pH 0.75 to 1.05 are selected from the chart in FIG. 7. For light cleaning a dilution ratio in a range of 3.4:1 to 5:1 and set point in a range of pH 1.05 to 1.2 are selected.

For cleaning an open vessel, input and output circulating lines connect directly to the vessel without using the vent drum. System operator judges level of cleaning required for the open heat exchanger, and from the chart of FIG. 7 selects optimum pH level to be set into pH controller. Initially, the main pump begins circulating water and the pH controller actuates the chemical pump to add chemical so as to bring circulating solution to dilution ratio corresponding to optimum pH level according to FIG. 7. As cleaning progresses the pH controller adds chemical as monitored pH value rises to effect a lowering of pH value in circulating solution to optimum level. When optimum level is reached and maintained for a given period, preferably one hour, without further addition of chemical to circulating solution, the heat exchanger surfaces have been cleaned and the system secured.

The pH sensor must be calibrated periodically to ensure continued operational accuracy. The sensor is calibrated by rinsing with fresh water and dipping sensor head in to first test solution of known value, say, 7.0 pH and a reading displayed. If needed, the sensor is adjusted at calibration opening to agree with pH value of first test solution. Calibration is confirmed by means of dipping a rinsed sensor head into a second test solution of known pH value, say 4.0 pH. The sensor should display the value of the second test solution without re-calibration. If not, the sensor is defective and in need of replacement.

In practice, the descaling machine can be set for normal operation, that is, for a level of normal cleaning of a heat exchanger. In normal setting, the pH controller has a low set point.

A method for descaling heat exchanger surfaces according to the invention comprises the steps of:

selecting a chemical consisting of a 10% concentration of hydrochloric acid in water as descaling agent in water, inspecting heat exchanger surfaces for extent of scaling, selecting one of heavy, normal, and light level of cleaning required for removing scale and mineral deposits from heat exchanger surfaces, selecting optimum pH level corresponding to level of cleaning selected, setting optimum pH level into pH controller, selecting a dilution ratio of water to chemical for descaling solution, mixing water and chemical to selected dilution ratio to form descaling solution, circulating descaling through heat exchanger for removing scale and mineral deposits from heat exchanger surface, monitoring pH level of circulating solution on a continuing basis and sending a signal to pH controller, comparing optimum and monitored pH levels by pH controller, adding chemical to circulating solution when monitored pH level is greater than optimum pH level in order to lower monitored level to optimum level as cleaning progresses, and securing system when monitored pH level reaches and remains the same as optimum pH level for a given period, e. g., one hour.

The term approximately for purposes of this application means plus or minus 10% of the values stated.

Various changes may be made to the structure embodying the principles of the invention. The foregoing embodiments are set forth in an illustrative and not in a limiting sense. The scope of the invention is defined by the claims appended hereto.

We claim:

1. A method for descaling heat exchanger surfaces comprising the steps of:

inspecting heat exchanger surfaces for extent of scaling, selecting a level of cleaning required for descaling said surfaces, selecting a chemical as descaling agent in water, selecting optimum pH level corresponding to level of cleaning selected, circulating descaling solution through heat exchanger for removing scale and mineral deposits from heat exchanger surface, monitoring pH level of circulating solution on a continuing basis, comparing optimum and monitored pH levels, adding chemical to circulating solution when monitored pH level is different than optimum pH level, and completing descaling when monitored pH level reaches and remains the same as optimum pH level for a given period.

2. A method as defined in claim 1 which further comprises the steps of:

setting optimum pH level into pH controller, selecting a dilution ratio of water to chemical for descaling solution, mixing water and chemical to selected dilution ratio to form descaling solution, sending a signal of monitored pH value to pH controller, comparing optimum and monitored pH levels by pH controller, and, adding chemical to circulating solution when monitored pH level is greater than optimum pH level in order to lower monitored level to optimum level as cleaning progresses.

3. A method for descaling heat exchanger surfaces comprising the steps of:

selecting a chemical consisting of a 10% concentration of acid in water as descaling agent in water, inspecting heat exchanger surfaces for extent of scaling, selecting one of heavy, normal, and light level of cleaning required for removing scale and mineral deposits from heat exchanger surfaces, selecting optimum pH level corresponding to level of cleaning selected, setting optimum pH level into pH controller, selecting a dilution ratio of water to chemical for descaling solution, mixing water and chemical to selected dilution ratio to form descaling solution, circulating descaling solution through heat exchanger for removing scale and mineral deposits from heat exchanger surface, monitoring pH level of circulating solution on a continuing basis and sending a signal to pH controller, comparing optimum and monitored pH levels by pH controller, adding chemical to circulating solution when monitored pH level is greater than optimum pH level in order to lower monitored level to optimum level as cleaning progresses, and completing descaling when monitored pH level reaches and remains the same as optimum pH level for a given period.

4. A method for descaling heat exchanger surfaces comprising the steps of:

selecting a chemical consisting of a 30% concentration of alkaline in water as descaling agent, inspecting heat exchanger surfaces for extent of scaling, selecting one of heavy, normal, and light level of cleaning required for removing scale and mineral deposits from heat exchanger surfaces, selecting optimum pH level corresponding to level of cleaning selected, setting optimum pH level into pH controller, selecting a dilution ratio of water to chemical for descaling solution, mixing water and chemical to selected dilution ratio to form descaling solution, circulating descaling solution through heat exchanger for removing scale and mineral deposits from heat exchanger surface, monitoring pH level of circulating solution on a continuing basis and sending a signal to pH controller, comparing optimum and monitored pH levels by pH controller, adding chemical to circulating solution when monitored pH level is lower than optimum pH level in order to raise monitored level to optimum level as cleaning progresses, and completing descaling when monitored pH level reaches and remains the same as optimum pH level for a given period.

* * * * *